US006493904B1

(12) United States Patent
Chiang

(10) Patent No.: US 6,493,904 B1
(45) Date of Patent: Dec. 17, 2002

(54) DOOR CLOSER

(75) Inventor: Chi-Tsao Chiang, Tao-Yuan Hsien (TW)

(73) Assignee: Heng Kuo Co., Ltd., Taoyuan Hsien (TW)

( * ) Notice: Subject to any disclaimer, the term of this patent is extended or adjusted under 35 U.S.C. 154(b) by 80 days.

(21) Appl. No.: 09/677,171

(22) Filed: Oct. 2, 2000

(51) Int. Cl.[7] ..... E05F 3/04
(52) U.S. Cl. ..... 16/56; 16/57; 16/58
(58) Field of Search ..... 16/56, 57, 58, 16/49, 52, DIG. 39, DIG. 21, DIG. 10

*Primary Examiner*—Anthony Knight
*Assistant Examiner*—Mark Williams

(57) ABSTRACT

A door closer includes casing fixedly fastened to a door frame, a hydraulic cylinder installed in the casing and holding a hydraulic fluid, a coupling block installed in one end of the hydraulic cylinder, the coupling block having a pivot shaft connected to a door, and a reciprocating mechanism coupled to the coupling block, fluid velocity regulating valves installed in the casing and controlled to adjust the velocity of the hydraulic fluid flowing in the casing, the reciprocating mechanism including a double-threaded adjustment rod for adjusting the spring power of compression springs thereof.

4 Claims, 5 Drawing Sheets

DOOR CLOSER

BACKGROUND OF THE INVENTION

1. Field of the Invention

The present invention relates to a door closer, and more particularly to such a door closer, which comprises a double-threaded adjustment rod controlled to regulate the spring power of the compression springs of the reciprocating mechanism thereof in adjusting the return speed of the door.

2. Description of the Prior Art

A regular door closer comprises an air cylinder fixedly fastened to the doorframe, and a reciprocating rod moved in and out of the air cylinder and fixedly connected to the door. This structure of door closer is functional, however the air pressure of the air cylinder is not adjustable. When installed, the user cannot adjust the return speed of the door.

SUMMARY OF THE INVENTION

The invention has been accomplished to provide a door closer, which eliminates the aforesaid drawback. According to one aspect of the present invention, the door closer comprises a casing, the casing comprising a hydraulic cylinder holding a hydraulic fluid, two tunnels disposed in communication with the hydraulic fluid in the hydraulic cylinder, and two end cap means respectively fastened to the tunnels at one end remote from the hydraulic cylinder; a coupling block mounted in one end of the hydraulic cylinder, the coupling block comprising a pivot shaft adapted for fastening to a door; and a reciprocating mechanism coupled to the coupling block and to move the pivot shaft in closing the door being fastened to the pivot shaft. According to another aspect of the present invention, the casing further comprises a plurality of mounting hole spaced between and disposed in communication with the tunnels, and a plurality of fluid velocity regulating valve respectively installed in the mounting holes and secured in place by a respective washer. According to still another aspect of the present invention, the adjustment rod comprises a plurality of O-rings respectively disposed in contact with an inside wall of the casing, the O-rings including a first O-ring disposed adjacent to the outer end of the adjustment rod to stop the hydraulic fluid from leaking out of the casing, and at least one second O-ring respectively disposed between each two of the mounting holes for enabling the fluid velocity regulating valves to work independently.

DETAILED DESCRIPTION OF THE PREFERRED EMBODIMENT

Figure 1:
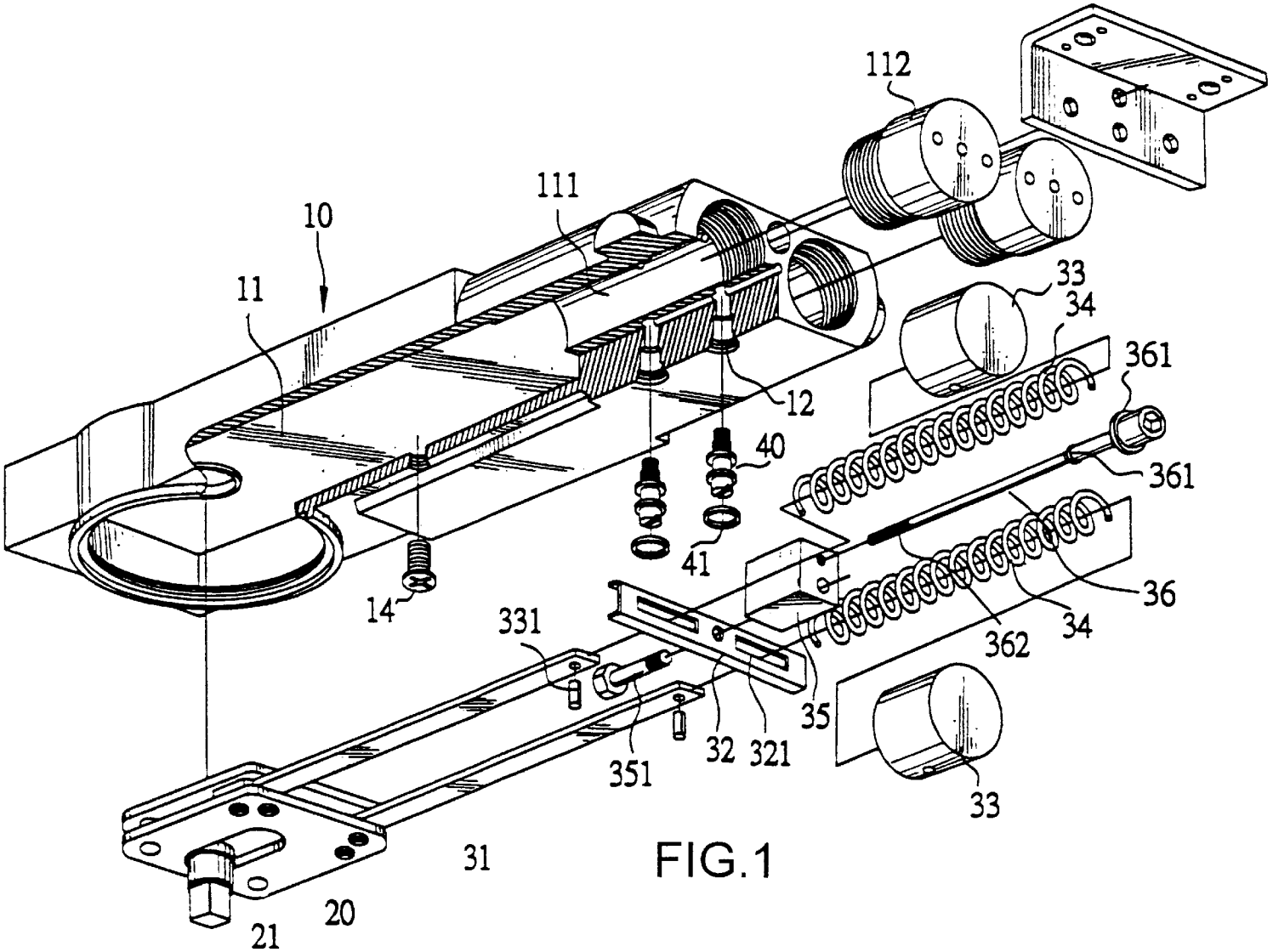
FIG. 1 is an exploded view of a door closer according to the present invention.
Figure 2:
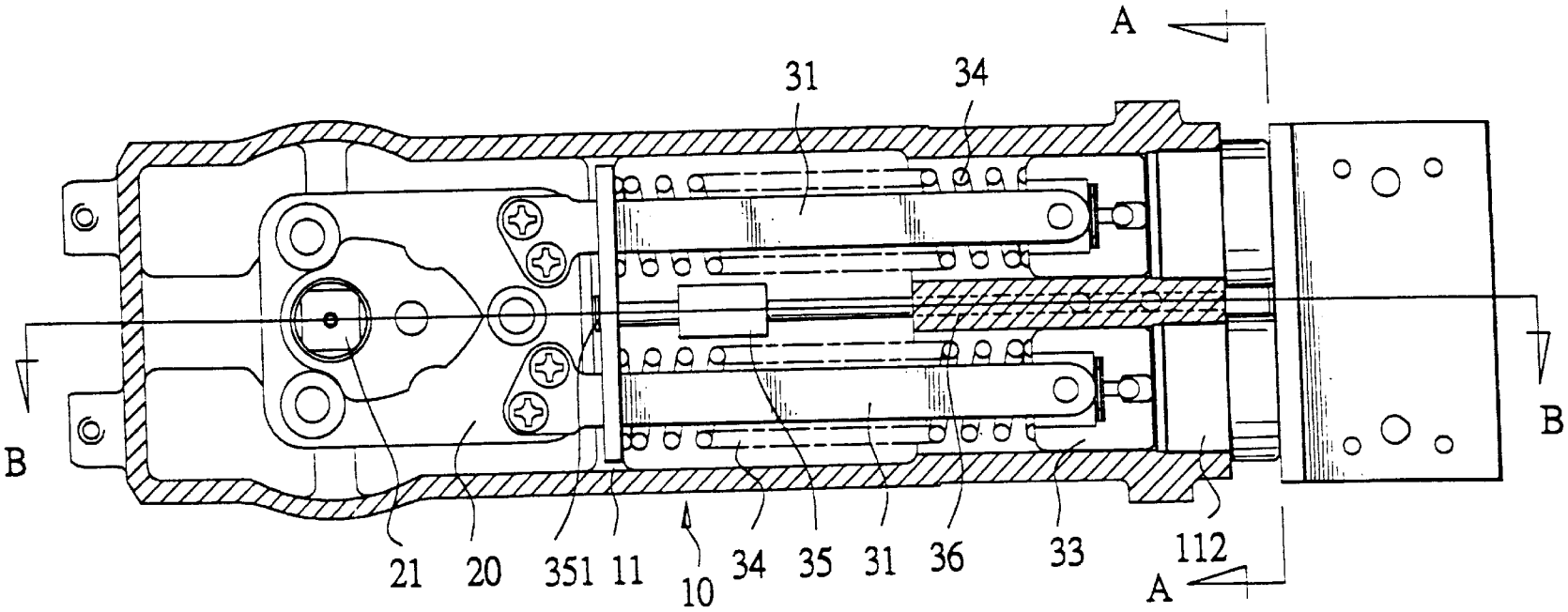
FIG. 2 is a bottom view of the door closer according to the present invention.
Figure 4:
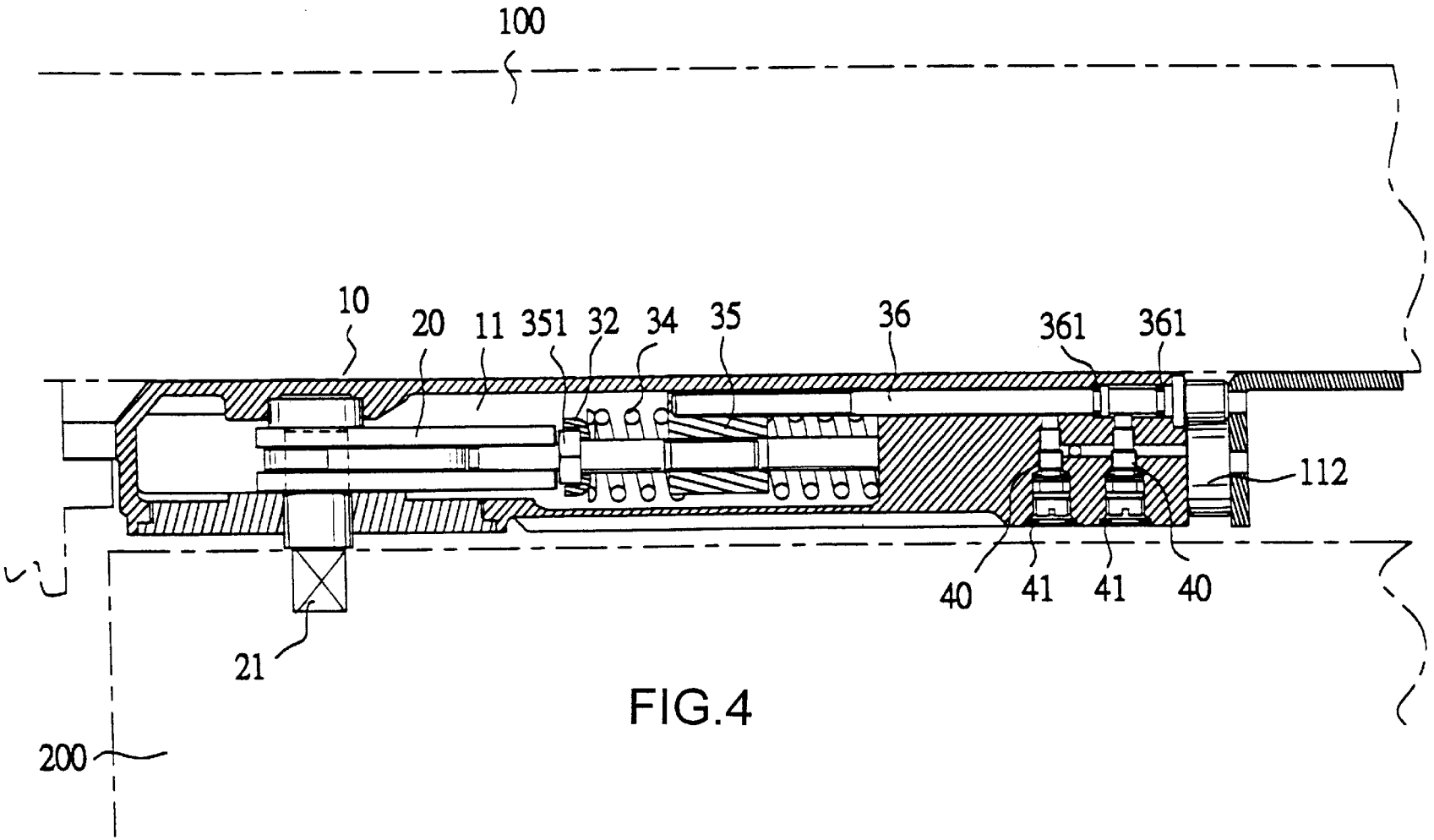
FIG. 4 is a sectional view taken along line B—B of FIG. 2.

Referring to FIGS. 1 and 2, a door closer in accordance with the present invention comprises a casing 10 fixedly mounted on the doorframe 100 (see FIG. 4). The casing 10 comprises two tunnels 111 longitudinally extended to one end thereof and arranged in parallel. A hydraulic cylinder 11 is fixedly mounted in the casing 10, and disposed in communication with the tunnels 111. The hydraulic cylinder 11 holds a hydraulic fluid. Two screw caps 112 are respectively threaded into the tunnels 111 at one end to stop the hydraulic fluid from leaking out of the tunnels 111. A coupling block 20 is installed in one end of the hydraulic cylinder 11, having a pivot shaft 21 perpendicularly protruded over one side thereof and fastened to the door 200 (see FIG. 4). A reciprocating mechanism 30 is pivoted to the coupling block 20, and controlled to move the pivot shaft 21 in closing the door 200 on the doorframe 100.

Figure 3:
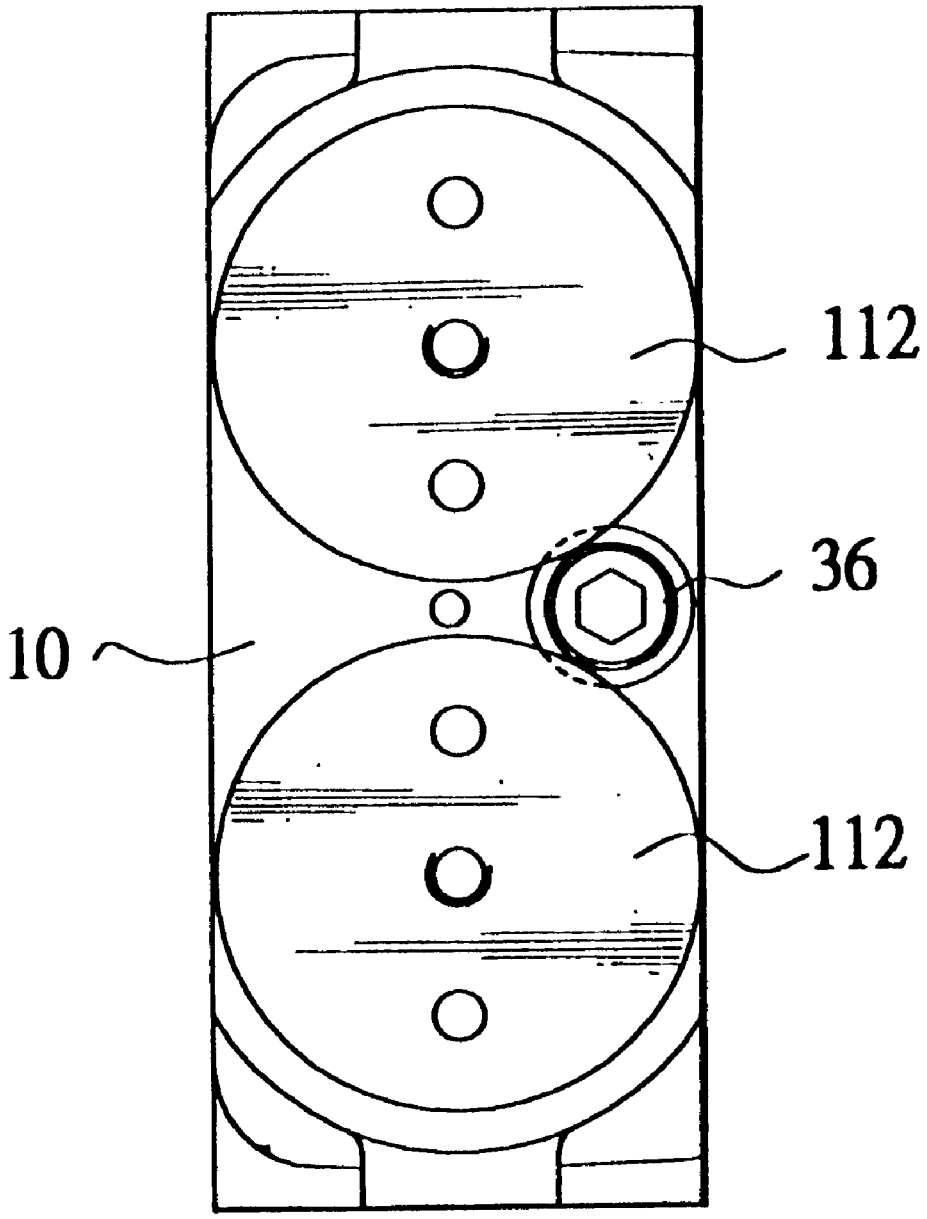
FIG. 3 is a sectional view taken along line A—A of FIG. 2.

The aforesaid reciprocating mechanism 30 comprises two parallel links 31 respectively connected to the coupling block 20 and disposed in parallel to the casing 10, a baffle 33 coupled to the links 31 and disposed adjacent to the coupling block 20, the baffle 33 having two through holes 321 for the passing of the links 31, two pistons 33 respectively fastened to the links 31 at one end remote from the coupling block 20 by a respective locating pin 321 and reciprocated with the links 31 in the tunnels 111, two compression springs 34 respectively mounted on the links 31 and stopped between the baffle 32 and the pistons 33, a screw bolt 351 mounted on the baffle 32 and stopped at one side of the coupling block 20, an adjustment block 35 threaded onto the screw bolt 351 and disposed at one side of the baffle 32 opposite to the coupling block 20, and an adjustment rod 36 connected to the adjustment block 35 and disposed in parallel to the links 31. The adjustment rod 36 has an outer end extended out of the casing 10 and spaced between the screw caps 112, and an inner end terminating in a double-threaded stem 362 threaded into the adjustment block 35. By means of rotating the adjustment rod 36 to move the adjustment block 35 and the baffle 32 forwards or backwards on the links 31, the compression springs 34 are compressed or released. The tunnels 111 have a particular cross section, for example, a circular cross section. The pistons 33 fit the cross section of the tunnels 111. The double thread design of the double-threaded stem 362 of the adjustment rod 36 enables the adjustment block 35 to be moved fast upon rotary motion of the adjustment rod 36. The outward movement of the adjustment rod 36 is limited to a particular position, i.e., the adjustment rod 36 will be stopped by the screw caps 112 when continuously turning the adjustment rod 36 outwards (see FIG. 3).

Figure 5:
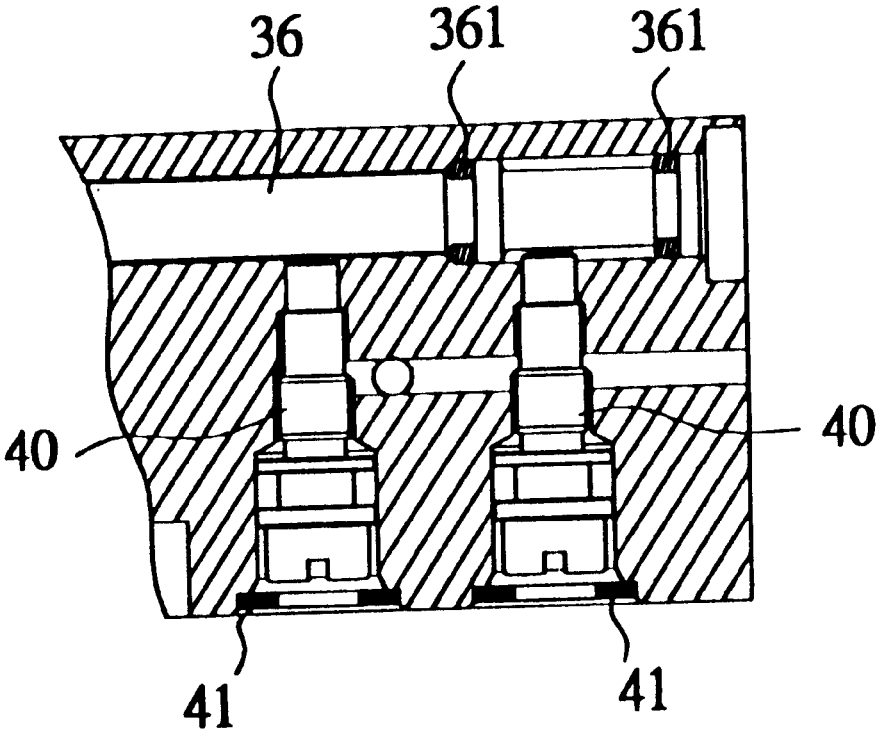
FIG. 5 is an enlarged view of a part of the present invention, showing the positions of the O-rings on the adjustment rod relative to the fluid velocity regulating valves.

Referring to FIGS. 4 and 5, the casing 10 further comprises at least one, for example, two mounting holes 12 spaced between and disposed in communication with the tunnels 111, and two fluid velocity regulating valves 40 respectively installed in the mounting holes 12 and secured in place by a respective washer 41.

Referring to FIGS. 4 and 5 again, At least one, for example, two O-rings 361 are mounted on the adjustment rod 36 to prevent a leakage. One O-ring 361 is disposed adjacent to the outer end of the adjustment rod 36, which protrudes outside the casing 10. The other O-ring 361 is disposed between the mounting holes 12 (the fluid velocity regulating valves 40) for enabling the fluid velocity regulating valves 40 to work independently.

Referring to FIGS. 1 and 4 again, a stop member, for example, a stop screw 14 is fastened to the casing 10 to stop the screw bolt 351 from touching the coupling block 20. If the screw bolt 351 is forced into contact with the coupling block 20 during adjustment of the adjustment rod 36, the coupling block 20 may be jammed and unable to be moved with the links 31.

While only one embodiment of the present invention has been shown and described, it will be understood that various modifications and changes could be made thereunto without departing from the spirit and scope of the invention disclosed.

What the invention claimed is:

1. A door closer comprising:

a casing, said casing comprising a hydraulic cylinder holding a hydraulic fluid, two tunnels disposed in communication with the hydraulic fluid in said hydraulic cylinder, and two end cap means respectively fastened to said tunnels at one end remote from said hydraulic cylinder;

a coupling block mounted in one end of said hydraulic cylinder, said coupling block comprising a pivot shaft adapted for fastening to a door; and a reciprocating mechanism coupled to said coupling block and to move said pivot shaft in closing the door being fastened to said pivot shaft, said reciprocating mechanism comprising two parallel links respectively connected to said coupling block and disposed in parallel to said casing, a baffle coupled to said links and disposed adjacent to said coupling block, said baffle having two through holes for the passing of said links, two pistons respectively fastened to said links at one end remote from said coupling block by a respective locating pin and reciprocated with said links in said tunnels, two compression springs respectively mounted on said links and stopped between said baffle and said pistons, a screw bolt mounted on said baffle and stopped at one side of said coupling block, an adjustment block threaded onto said screw bolt and disposed at one side of said baffle opposite to said coupling block, and an adjustment rod connected to said adjustment block and disposed in parallel to said links for turning by the user to move said adjustment block and said baffle along said links, said adjustment rod having an outer end extended out of said casing and spaced between said end cap means and an inner end terminating in a double-threaded stem threaded into said adjustment block.

2. The door closer of claim 1 wherein said casing further comprises a plurality of mounting hole spaced between and disposed in communication with said tunnels, and a plurality of fluid velocity regulating valves respectively installed in said mounting holes and secured in place by a respective washer.

3. The door closer of claim 2 wherein said adjustment rod comprises a plurality of O-rings respectively disposed in contact with an inside wall of said casing, said O-rings including a first O-ring disposed adjacent to the outer end of said adjustment rod to stop said hydraulic fluid from leaking out of said casing, and at least one second O-ring respectively disposed between each two of said mounting holes for enabling said fluid velocity regulating valves to work independently.

4. The door closer of claim 1 further comprising stop means fastened to said casing and adapted to stop said screw bolt from touching said coupling block.

* * * * *